US009457241B2

(12) United States Patent
Hebreo

(10) Patent No.: US 9,457,241 B2
(45) Date of Patent: Oct. 4, 2016

(54) GOLF CLUB HEAD

(71) Applicant: Acushnet Compnay, Fairhaven, MA (US)

(72) Inventor: Jonathan Hebreo, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 264 days.

(21) Appl. No.: 14/132,345

(22) Filed: Dec. 18, 2013

(65) Prior Publication Data

US 2015/0165280 A1 Jun. 18, 2015

(51) Int. Cl.
*A63B 53/00* (2015.01)
*A63B 53/04* (2015.01)

(52) U.S. Cl.
CPC ..... *A63B 53/0466* (2013.01); *A63B 53/047* (2013.01); *A63B 53/0475* (2013.01); *A63B 53/0487* (2013.01); *A63B 2053/0429* (2013.01); *A63B 2053/0454* (2013.01); *A63B 2053/0462* (2013.01); *A63B 2209/00* (2013.01)

(58) Field of Classification Search
USPC ..... 473/324–350
See application file for complete search history.

(56) References Cited

U.S. PATENT DOCUMENTS 4,027,885 A 6/1977 Rogers ..... 273/169
4,511,145 A * 4/1985 Schmidt ..... A63B 53/04 473/346
4,740,345 A 4/1988 Nagasaki et al. ..... 264/257
4,792,139 A 12/1988 Nagasaki et al. ..... 273/167 H
5,106,094 A * 4/1992 Desbiolles ..... A63B 53/04 473/342
5,255,918 A * 10/1993 Anderson ..... A63B 53/04 473/330
5,467,983 A * 11/1995 Chen ..... A63B 53/04 473/342
5,472,201 A * 12/1995 Aizawa ..... A63B 53/04 473/329
5,766,094 A * 6/1998 Mahaffey ..... A63B 53/04 473/342
RE35,955 E * 11/1998 Lu ..... A63B 53/04 473/329
5,863,261 A 1/1999 Eggiman ..... 473/329
6,152,833 A * 11/2000 Werner ..... A63B 53/04 473/324
6,299,547 B1 * 10/2001 Kosmatka ..... A63B 53/04 473/329
6,695,715 B1 * 2/2004 Chikaraishi ..... A63B 53/0466 473/329
6,932,716 B2 * 8/2005 Ehlers ..... A63B 53/04 473/329
6,979,270 B1 * 12/2005 Allen ..... A63B 53/04 473/290
7,056,228 B2 * 6/2006 Beach ..... A63B 53/0466 473/345
7,192,364 B2 * 3/2007 Long ..... A63B 53/04 473/329

(Continued)

FOREIGN PATENT DOCUMENTS

JP 06015017 A * 1/1994
JP 07275411 A * 10/1995

(Continued)

*Primary Examiner* — Gene Kim
*Assistant Examiner* — Matthew B Stanczak
(74) *Attorney, Agent, or Firm* — Smith, Gambrell & Russell, LLP

(57) ABSTRACT

A golf club head having a reinforced striking face that includes a thin striking plate with a reinforcement plate disposed behind the striking plate. The striking face may have lubricant between the striking plate and reinforcement plate, separation volumes between the striking plate and reinforcing plate, or a combination thereof. The thicknesses of the striking and reinforcing plates may vary within the plates themselves and may have regions intended to mate with each other to create reinforced regions.

20 Claims, 8 Drawing Sheets

(56) References Cited

U.S. PATENT DOCUMENTS

| | | | | |
|---|---|---|---|---|
| 7,211,006 | B2 * | 5/2007 | Chang | A63B 53/04 473/326 |
| 7,357,730 | B2 * | 4/2008 | Shieh | A63B 53/0475 473/342 |
| 7,367,897 | B2 * | 5/2008 | Poynor | A63B 53/0466 473/329 |
| 7,798,913 | B2 * | 9/2010 | Noble | A63B 53/04 473/324 |
| 7,798,914 | B2 * | 9/2010 | Noble | A63B 53/0466 473/324 |
| 8,187,116 | B2 * | 5/2012 | Boyd | A63B 53/0466 473/288 |
| 8,403,771 | B1 * | 3/2013 | Rice | A63B 53/04 473/328 |

FOREIGN PATENT DOCUMENTS

| | | | | |
|---|---|---|---|---|
| JP | 09173510 | A | * | 7/1997 |
| JP | 09239076 | A | * | 9/1997 |
| JP | 09327534 | A | * | 12/1997 |
| JP | 11042302 | A | * | 2/1999 |
| JP | 11192329 | A | * | 7/1999 |
| JP | 11244428 | A | * | 9/1999 |
| JP | 2001000599 | A | * | 1/2001 |
| JP | 2001058015 | A | * | 3/2001 |
| JP | 2001062004 | A | * | 3/2001 |
| JP | 2001137396 | A | * | 5/2001 |
| JP | 2001238988 | A | * | 9/2001 |
| JP | 2001309999 | A | * | 11/2001 |
| JP | 2003210624 | A | * | 7/2003 |
| JP | 2004174100 | A | * | 6/2004 |
| WO | WO 2004067110 | | * | 8/2004 |

* cited by examiner

GOLF CLUB HEAD

FIELD OF THE INVENTION

The present invention relates to a golf club head having a reinforced face configured to, among other things, provide increased ball speed and increased durability for sustained use. More specifically, the present invention relates to a golf club head having a dual-plate striking wall that includes a thin striking face that increases energy transfer to a golf ball and a reinforcing plate behind the striking face to increase the durability of the face. The present invention also relates to methods of making the novel golf club head.

BACKGROUND OF THE INVENTION

It is a primary goal of golf players to reduce the total number of swings needed to complete a round, thereby improving their score. Therefore, it is often desirable for a golf player to be able to drive a golf ball for a very long distance with a single swing. A player's ability to achieve long driving distances is influenced by both the player's skill and their equipment.

In particular, it has been found that various design parameters may affect the performance of a golf club. Among these parameters, it has been found that the use of a thin face will improve the driving distance of a golf club. As such, recent attempts have been made to construct golf club heads with thinner faces in an effort to increase the maximum driving distance of the golf club.

For example, U.S. Pat. No. 8,187,116 generally discloses a golf club head with a thin face and a second wall positioned behind the face and separated from the face by a cavity. However, the club head disclosed in U.S. Pat. No. 8,187,116 results in increased failure rates. Without wishing to be bound by theory, it is believed that this increased failure experienced in such club heads is the result of the thin construction of the face, and the increased deformation that occurs in such a thin surface upon striking a golf ball.

Accordingly, there remains a need in the art to develop a golf club head that is capable of achieving increased driving distances, while at the same time providing an improved durability to the club head to prevent increased failure rates.

SUMMARY OF THE INVENTION

The present invention is directed to a golf club head including: a body including a striking face and an inner volume, wherein the striking face includes a striking plate and a reinforcing plate, wherein the striking plate includes an outer surface that faces outward from the club body and an inner surface that faces the inner volume of the body, wherein the striking plate includes a plurality of regions, wherein the plurality of regions includes at least one recessed region on the inner surface having a lesser thickness than other of the plurality of regions, wherein the reinforcing plate includes a first surface that faces the inner surface of the striking plate and a second surface that faces the inner volume of the body, wherein the first surface includes at least one protruding region with a greater thickness than one or more other regions of the reinforcing plate, and wherein the at least one protruding region mates with the at least one recessed region in the striking plate to define at least one reinforced region within the striking face.

In one embodiment, the striking face includes a layer disposed between the striking plate and the reinforcing plate. In another embodiment, the striking face includes lubricant between the at least one recessed region and the at least one protruding region. In yet another embodiment, the at least one recessed region includes a first recessed region and a second recessed region, and wherein the at least one protruding region includes a first protruding region and a second protruding region, and wherein the first recessed region mates with the first protruding region and the second recessed region mates with the second protruding region. In still another embodiment, the striking face includes a first lubricant between the first recessed region and the first protruding region, and wherein the striking face includes a second lubricant between the second recessed region and the second protruding region.

The at least one recessed region and the at least one protruding region may be in contact with one another. In one embodiment, the club head further includes one or more separation volumes disposed between the inner surface of the striking plate and the first surface of the reinforcing plate. In yet another embodiment, at least one of the one or more separation volumes consists of air. In still another embodiment, at least one of the one or more separation volumes includes a filler material. The at least one reinforced region may correspond with a center of the striking face, and may exclude both a heel region and a toe region of the striking face.

In one embodiment, the at least one reinforced region includes an elliptical shape. In another embodiment, the at least one reinforced region extends from approximately a sole end of the striking face to a crown end of the striking face.

The present invention also related to a golf club head including: a body including a striking face and an inner volume, wherein the striking face includes a striking plate and a reinforcing plate, wherein the striking plate includes an outer surface that faces outward from the club body and an inner surface that faces the inner volume of the body, wherein the striking plate includes a plurality of regions, wherein the plurality of regions includes at least one recessed region on the inner surface having a lesser thickness than other of the plurality of regions, wherein the reinforcing plate includes a first surface that faces the inner surface of the striking plate and a second surface that faces the inner volume of the body, wherein the first surface includes at least one protruding region with a greater thickness than one or more other regions of the reinforcing plate, wherein the at least one protruding region mates with the at least one recessed region in the striking plate to define at least one reinforced region within the striking face, and wherein the at least one reinforced region excludes both a heel region and a toe region of the striking face.

In one embodiment, the striking face includes lubricant between the at least one recessed region and the at least one protruding region. In another embodiment, the at least one reinforced region excludes a region at the center of the striking face. In yet another embodiment, at least one separation volume disposed between the inner surface of the striking plate and the first surface of the reinforcing plate. In still another embodiment, at least one separation volume includes air, a filler material, or a combination thereof.

The present invention is also directed to a golf club head including: a body including a striking face and an inner volume, wherein the striking face includes a striking plate and a reinforcing plate, wherein the striking plate includes an outer surface that faces outward from the club body and an inner surface that faces the inner volume of the body, wherein the striking plate includes a plurality of regions, wherein the plurality of regions includes at least two recessed regions on the inner surface having a lesser thickness than other of the plurality of regions, wherein the reinforcing plate includes a first surface that faces the inner surface of the striking plate and a second surface that faces the inner volume of the body, wherein the first surface includes at least two protruding regions with a greater thickness than one or more other regions of the reinforcing plate, wherein the at least two protruding regions mate with the at least two recessed regions in the striking plate to define at least two reinforced regions within the striking face, and wherein the at least two reinforced regions each extend from approximately a sole end of the striking face to a crown end of the striking face.

In one embodiment, the at least two reinforced regions include a heel intermediate region and a toe intermediate region. In another embodiment, the striking face includes a layer disposed between the striking plate and the reinforcing plate.

Both the foregoing general description and the following detailed description are exemplary and explanatory only and are intended to provide further explanation of the invention as claimed. The accompanying drawings are included to provide a further understanding of the invention; are incorporated in and constitute part of this specification; illustrate several embodiments of the invention; and, together with the description, serve to explain the principles of the invention.

BRIEF DESCRIPTION OF THE DRAWINGS

Further features and advantages of the invention can be ascertained from the following detailed description, which is provided in connection with the drawings described below.

DETAILED DESCRIPTION OF THE INVENTION

The present invention is directed to a golf club head having a reinforced face that includes at least (1) a thin striking face that, among other advantages, increases energy transfer to a golf ball and (2) a reinforcing plate behind the striking face that increases the durability of the striking plate. The reinforced face is contemplated for use at least in metal-wood type golf club heads, hybrid golf club heads, and iron-type golf club heads (including wedge-type club heads), utility-type, specialty-type, and putter-type golf club heads. As understood by those of ordinary skill in the art, each of these styles has a prescribed function and make up. Accordingly, while the description below provides several specific examples of the type of club heads contemplated for incorporation of a reinforced striking face according to the present invention, the invention is not intended to be limited by the specific embodiments.

The Golf Club Head

Golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club it contacts and interacts with the ground during the swing.

As generally shown in the figures, golf club heads according to the present invention (10/11) may have a club head body 101/201 that includes a crown 102/201 and a sole 103/203. Extending between the crown 102/202 and the sole 103/203 are a toe end 104/204, a heel end 105/205, a rear end 106/206, and a strike face 107/207. The heel end 105/205 opposes the toe end 104/204 and the rear end 106/206 opposes the strike face 107/207. The club head 10/11 may include a hollow space 108/208 in a volume between the opposing toe and heel ends 104/204 and 105/205, respectively, and between the opposing rear end 106/206 and striking wall 107/207.

A first end of a shaft 3/13 may be inserted into the reception cavity of a hosel 5/15 on the club head 10/11 to form a golf club 1/2. The golf club shaft 3/13 includes a second end that is opposite the first end, where the second end may be adapted to accommodate a grip or handle member 4/14. The hosel 5/15 may be a protrusion that extends from the club head 10/11, or may instead be a recess extending into the hollow space 108/208 of the club head 10/11.

Figure 2A:
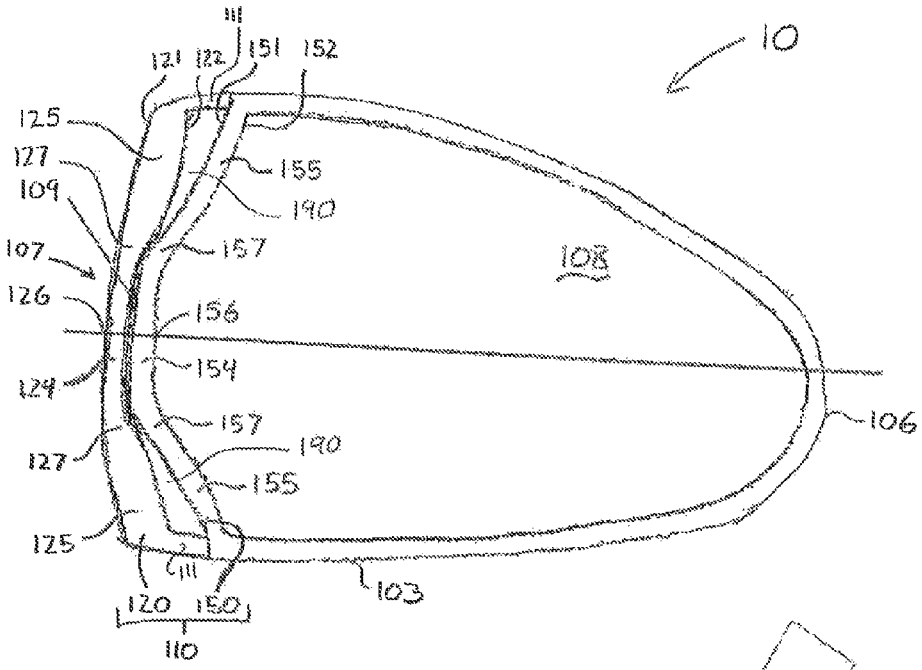
FIG. 2A illustrates a cross-sectional view of the club head, as seen along line A-A in FIG. 1
Figure 5A:
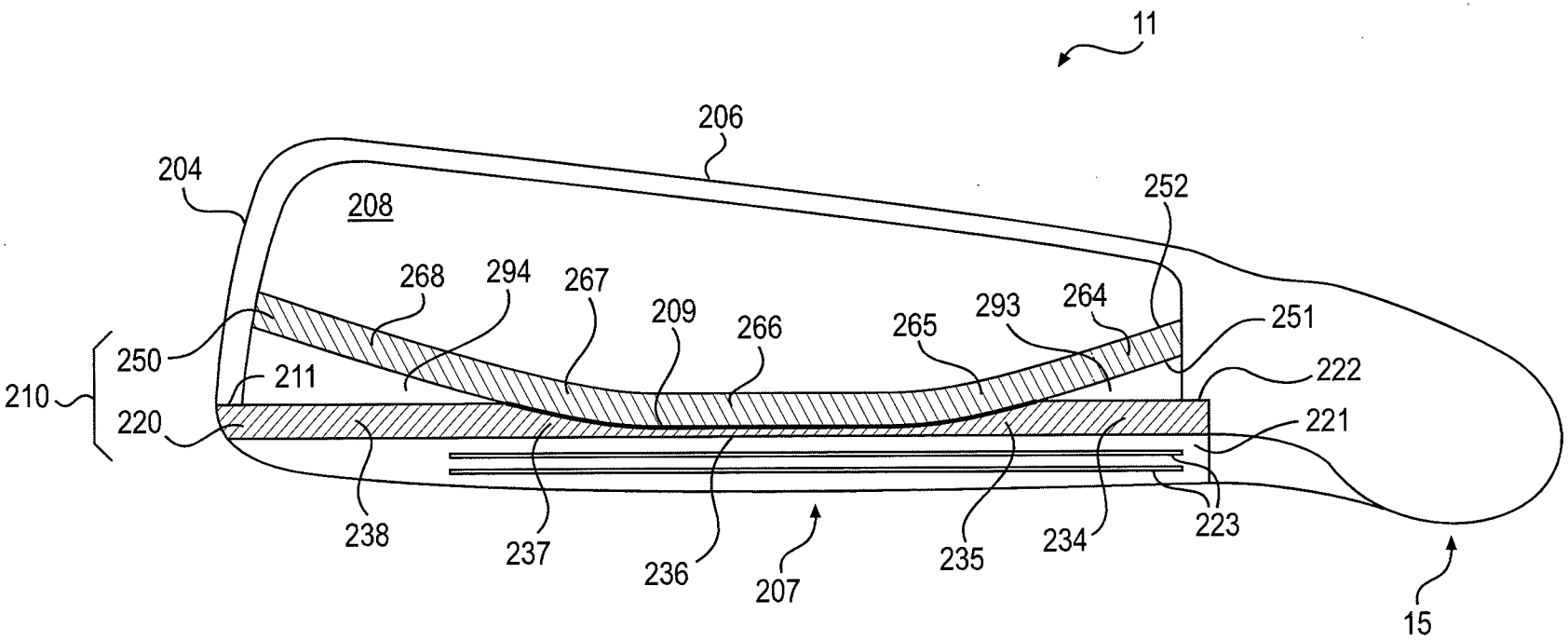
FIG. 5A illustrates a cross-sectional view of the club head, as seen along line C-C in FIG. 4

As shown in FIGS. 2A and 5A, the striking face 107/207 may include a dual-plate unit 110/210 that includes at least a striking plate 120/220 and a reinforcing plate 150/250. The striking plate 120/220 is an external wall of the club head 10/11 for striking golf balls, and may include a friction and/or flexibility enhancing texture 123/223 on an outward facing surface 121/221. The friction and/or flexibility enhancing texture 123/223 include a plurality of grooves or channels. The striking plate 120/220 may also be include a plurality of distinct sets of texturing and surface roughening to accommodate a plurality of different shots. For example, in one embodiment, the striking plate may include grooves that have a plurality of portions, including a radiused or angled portion, a portion having substantially parallel walls, a portion having a v-shape, and a curved portion. Such grooves may also be characterized by various dimensions, including draft angle, inclusive side wall angle, width, depth, cross-sectional area, spacing, and pitch ratio.

The reinforcing plate 150/250 may be an internal wall positioned within the hollow space 108/208 of the club head 10/11 for structurally reinforcing the striking plate 120/220. An outward facing surface 151/251 of the reinforcing plate 150/250 is in surface-to-surface contact with an inward facing surface 122/222 of the striking plate 120/220.

In particular, one or both of the striking plate 120/220 and the reinforcing plate 150/250 includes a layer of lubrication 109/209. In one aspect, the lubrication 109/209 is a layer of the striking plate 120/220, at the inward facing surface 122/22. In another aspect, the lubrication 109/209 is a layer of the reinforcing plate 150/250, at the outward facing surface 151/251. In a further aspect, there are two layers of lubrication 109/209 with one layer being a layer of the striking plate 120/220, at the inward facing surface 121/221 and the other layer being a layer of the reinforcing plate 150/250, at the outward facing surface 151/251. The lubrication 109/209 may also be formed as an entirely separate layer by coating the lubrication over the respective surface. Alternatively, the lubrication 109/209 may be formed as a surface treatment given to a surface for the respective plate to which it is applied. A thickness of lubrication 109/209 may be from about 1 micron to about 0.1 micron, with a thickness of a dual-layer lubrication 109/209 being from about 1 micron to about 0.2 micron. In one embodiment, the lubrication layer is about 0.75 micron to about 0.25 micron. In another embodiment, the lubrication layer is about 0.6 micron to about 0.3 micron. Non-limiting examples of lubrication materials may include oil, grease, silicone, wax, surface treatments (impregnated and non-impregnated), and combinations thereof.

Without being bound by any particular theory, the presence of the lubrication 109/209 facilitates the energy transfer from the striking plate 120/220 in concert with the reinforcement from the reinforcing plate 150/250, while minimizing shear stresses between the two plates. In particular, upon striking a golf ball, the thin-wall striking plate 120/220 will undergo a mechanical deformation resulting in both a rearward deflection and an arcuate expansion of the plate. If placed in direct surface-to-surface contact, the deflection and an arcuate expansion of the striking plate 120/220 would generate significant shear stresses on the outward facing surface 151/251 of the reinforcing plate 150/250.

However, due to the inclusion of the lubrication 109/209, the striking plate 120/220 is capable of deflecting and deforming separately from the reinforcing plate 150/250; and shear stresses between the plates 120/220 and 150/250 are substantially reduced. At the same time, because the lubrication 109/209 is only a thin layer, or even a mere surface treatment, between the plates 120/220 and 150/250, an energy from the deformation of the striking plate 120/220 is transmitted through the lubrication 109/209 and to the reinforcing plate 150/250 nearly instantly. Upon receiving the transmitted deformation force, the reinforcing plate 150/250 is momentarily deformed and generates a counterforce that is transmitted back through the lubrication 109/209 to the striking plate 120/220, thereby reinforcing the striking plate 120/220 against excessive deformation. In this manner, the surface-to-surface contact of the plates 120/220 and 150/250 permits the striking plate 120/220 to deform in a manner that increases energy transfer to a struck ball and permits the reinforcing plate 150/250 to generate a near instantaneous counterforce for reinforcing the striking plate 120/220. At the same time, the shear stresses that would otherwise result from a direct surface-to-surface contact between the plates 120/220 and 150/250 are minimized.

In several embodiments, the surface-to-surface contact of the reinforcing plate 150/250 with the striking plate 120/220 is non-continuous over the respective inward and outward facing surfaces 122/222 and 151/251, such that a surface-to-surface contact is provided only at select locations over the surfaces 122/222 and 151/251. In one aspect, the non-continuous surface-to-surface contact of the plates 120/220 and 150/250 is achieved by constructing the reinforcing plate 150/250 with an irregular outward surface 151/251 having a curvature different from the curvature of the striking plate 120/220, such that only a select portion of the outward facing wall 151/251 is in surface-to-surface contact with the inward facing wall 122/222. The remainder of the outward facing wall 151/251 curves and extends away from the inward facing wall 122/222. In another aspect, the non-continuous surface-to-surface contact of the plates 120/220 and 150/250 is achieved by constructing the reinforcing plate 150/250 with an irregular outward surface 151/251 having one or more protruding regions, such that the protruding regions are in surface-to-surface contact with the inward facing wall 122/222. The remainder of the outward facing wall 151/251 remains further separated from the inward facing wall 122/222. In a further aspect, the non-continuous surface-to-surface contact of the plates 120/220 and 150/250 is achieved by constructing the reinforcing plate 150/250 with an irregular outward surface 151/251 having both a curvature different from the curvature of the striking plate 120/220 and one or more protruding regions.

By constructing a dual-plate unit 110/210 with a reinforcing plate 150/250 and a striking plate 120/220 that are in non-continuous surface-to-surface contact, there is achieved a unique configuration where regions of the reinforcing plate 150/250 and the striking plate 120/220 that are in surface-to-surface contact define a reinforcement pattern 180-183/280-283 in the dual-plate unit 110/210. Regions of the reinforcing plate 150/250 and the striking plate 120/220 that are not in surface-to-surface contact define one or more separation volumes 190-197/290-297 in the dual-plate unit 110/210. In this manner, the dual-plate unit 110/210 is characterized by a reinforcement pattern 180-183/280-283 and one or more separation volumes 190-197/290-297 arranged about the reinforcement pattern 180-183/280-283.

In one aspect, the striking plate 120/220 and the reinforcing plate 150/250 may have constant thicknesses along their respective lengths. In another aspect, one or both of the striking plate 120/220 and the reinforcing plate 150/250 may have varying thicknesses along their respective lengths. In one example, regions of the striking plate 120/220 that correspond with the reinforcement pattern 180-183/280-283 of the dual-plate unit 110/210 may have a lesser thickness, while regions of the striking plate 120/220 that do not correspond with the reinforcement pattern 180-183/280-283 may have a greater thickness (with thickness being measured in the striking-wall-to-rear-end direction). Likewise, regions of the reinforcing plate 150/250 that correspond with the reinforcement pattern 180-183/280-283 of the dual-plate unit 110/210 may have a lesser thickness, while regions of the reinforcing plate 150/250 that do not correspond with the reinforcement pattern 180-183/280-283 may have a greater thickness. In a further aspect, regions of the reinforcing plate 150/250 that correspond with the reinforcement pattern 180-183/280-283 of the dual-plate unit 110/210 may have a greater thickness, while regions of the reinforcing plate 150/250 that do not correspond with the reinforcement pattern 180-183/280-283 may have a lesser thickness.

In another example, one or both of the striking plate 120/220 and the reinforcing plate 150/250 may have varying thicknesses in one or more regions, including regions that correspond with the reinforcement pattern 180-183/280-283 of the dual-plate unit 110/210 and regions that do not correspond with the reinforcement pattern 180-183/280-283. For example, in one embodiment, the striking plate 120/220 may have at least three regions of differing thicknesses. In another embodiment, the reinforcing plate 150/250 may have at least three regions of differing thicknesses.

In embodiments where the striking plate 120/220 has different thicknesses in different regions, the regions corresponding to the reinforcement pattern 180-183/280-283 may have a thickness from about 0.1 mm to about 5 mm, preferably from about 0.1 mm to about 3 mm, and more preferably between about 0.5 mm to about 1.5 mm. Meanwhile, the regions not corresponding to the reinforcement pattern 180-183/280-283 may have a thickness from about 1 mm to about 6 mm, preferably from about 1 mm to about 4 mm, and more preferably between about 2 mm to about 3.5 mm.

In this aspect of the invention, the lesser thickness of the striking plate 120/220 at the regions corresponding to the reinforcement pattern 180-183/280-283 results in an increased energy transfer to golf balls struck at those regions, which, in turn, results in an increased ball speed and an increased driving distance. The reinforcement pattern 180-183/280-283 may be configured to correspond with the "sweet spot" of the striking face 107/207 such that the increased ball speed and increased driving distance is conferred to golf balls that are struck with the preferred portion of the striking face 107/207. Meanwhile, the surface-to-surface contact of the reinforcing plate 150/250 at the regions corresponding to the reinforcement pattern 180-183/280-283 provides a reinforcing support that compensates for the decreased thickness of the striking plate 120/220, thereby increasing the durability of the striking plate 120/220 at the regions of lesser thickness.

The greater thickness of the striking plate 120/220 at the regions not corresponding to the reinforcement pattern 180-183/280-283 results in a lesser transfer of energy to golf balls struck at those regions, as compared to the transfer of energy achieved by the regions corresponding to the reinforcement pattern. This, in turn, results in a lesser ball speed, and a lesser driving distance, which is beneficial in that the regions not corresponding to the reinforcement pattern 180-183/280-283 are configured to not correspond with the "sweet spot" of the striking face 107/207. Accordingly, lesser ball speed and lesser driving distance are conferred to golf balls that are struck with non-preferred portions of the striking face 107/207. Meanwhile, though lacking a reinforcement support from the reinforcing plate 150/250, the greater thickness of the regions not corresponding to the reinforcement pattern 180-183/280-283 provides these regions with a durability that substantially matches the durability of the thinner-reinforced sections.

In embodiments where the reinforcing plate 150/250 has different thicknesses in different regions, the regions corresponding to the reinforcement pattern 180-183/280-283 may have a thickness from about 0.5 mm to about 5 mm, preferably from about 0.5 mm to about 3 mm, and more preferably between about 1.0 mm to about 2.5 mm. Meanwhile, the regions not corresponding to the reinforcement pattern 180-183/280-283 may have a thickness from about 0.5 mm to about 5 mm, preferably from about 0.5 mm to about 3.5 mm, and more preferably between about 1 mm and about 3 mm.

Without being bound to any particular theory, the effect of the thicker/thinner regions in the reinforcing plate is two-fold. First, the variable thickness will optimize the performance by making the compliance of the plate to be adjusted depending on the impact location. Second, the variable thickness will account for stresses that may lead to failure (denting or cracking).

In one aspect, the one or more separation volumes 190-197/290-297 between the striking plate 120/220 and the reinforcing plate 150/250, arranged about the reinforcement pattern 180-183/280-283, are empty volumes filled only with air. In another aspect, the one or more separation volumes 190-197/290-297 may contain a filler material that further influences the deflection and/or reinforcement characteristics of the dual-plate unit 110/210. Non-limiting examples of suitable filler materials may include rubber, foam, and combinations thereof. In embodiments where there are a plurality of separation volumes 190-197/290-297, one or more of the separation volumes 190-197/290-297 may be filled only with air while one or more of the other separation volumes 190-197 may contain a filler material. In other words, the plurality of separation volumes 190-197/290-297 may differ in the filler material.

In another embodiment, the separation volume may be a variable gap between the striking plate 120/220 and the reinforcing plate 150/250. For example, the variable gap may have at least one region having a first thickness and at least one second region having a second thickness different from the first. One of ordinary skill in the art will appreciate that the variable gap may have more than two regions with differing thicknesses.

With the foregoing principles, one skilled in the art will appreciate that the striking zone and striking characteristics of a striking face 107/207 in a golf club head may be customized by varying one or more of: the surface-to-surface contact of the striking plate 120/220 and the reinforcement plate 150/250; the reinforcement pattern 180-183/280-283 in the dual-plate unit 110/210; the thickness of the striking plate 120/220 and/or reinforcing plate 150/250 at regions corresponding to the reinforcement pattern 180-183/280-283, as well as the regions not corresponding to the reinforcement pattern 180-183/280-283; and the contents of the separation volumes 190-197/290-297 in the dual-plate unit 110/210.

Figure 1:
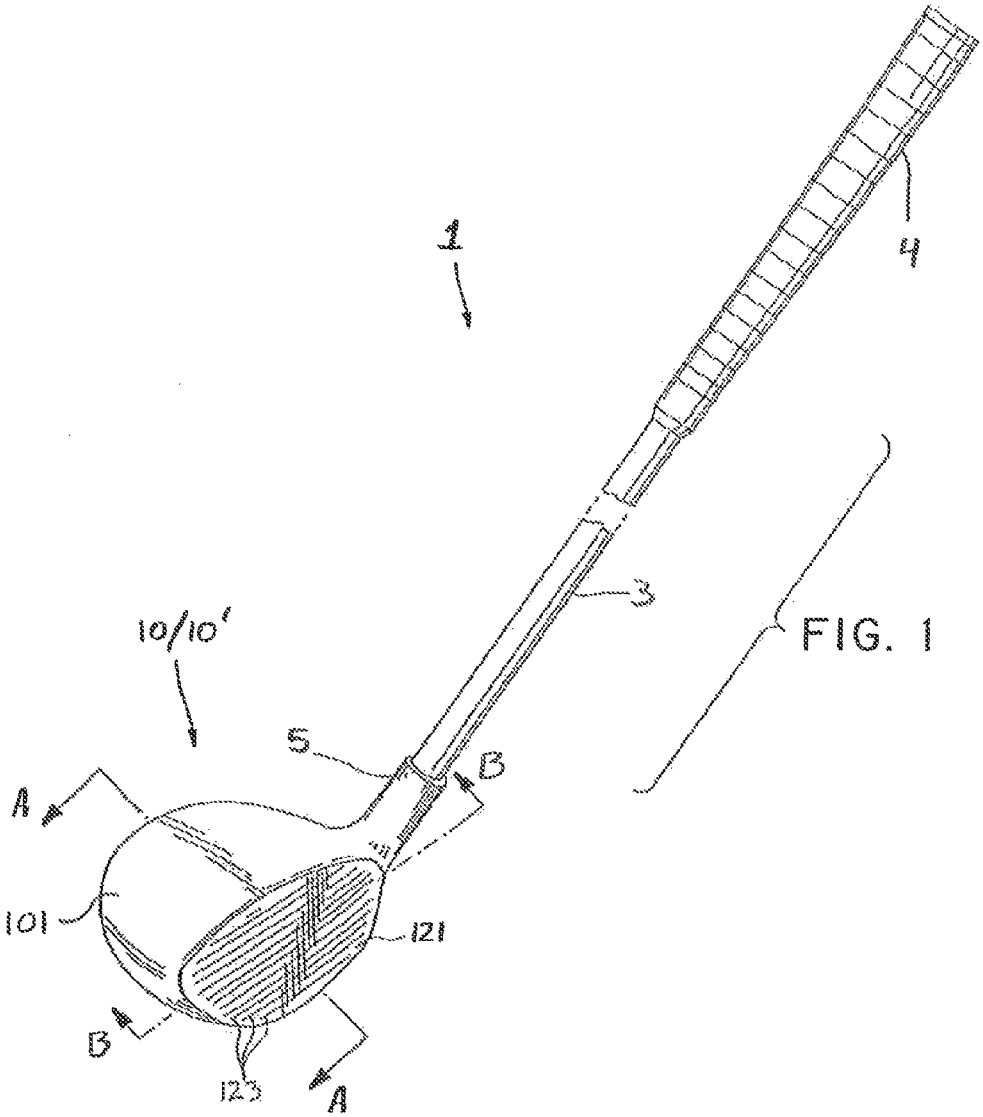
FIG. 1 illustrates a wood-type golf club according to one embodiment of the present invention.
Figure 2B:
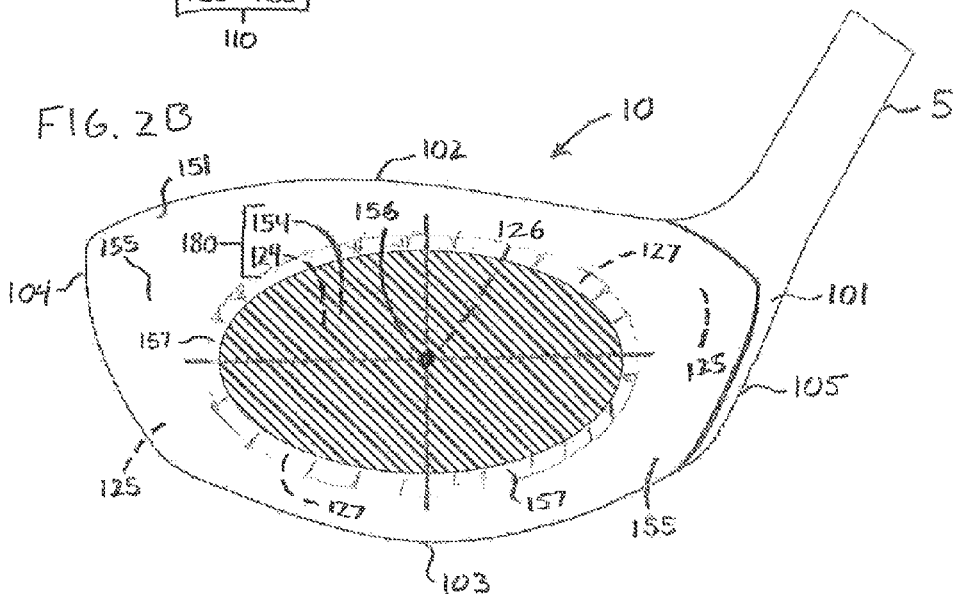
FIG. 2B illustrates a front view of the club head, as seen along line B-B in FIG. 1, with the face removed.

As shown in FIGS. 1 and 2A-2B, the club head 10 of the present invention may be a metalwood-type club head for use with a metalwood-type golf club 1. The club head 10 includes a dual-plate unit 110 having a striking plate 120 and a reinforcing plate 150 that are in non-continuous surface-to-surface contact, such that the dual-plate unit 110 is provided with an elliptical reinforcement pattern 180 at a center region 124/154. The elliptical reinforcement pattern 180 may have an area from about 0 $cm^2$ to about 150 $cm^2$ and a surface area ratio of the reinforcement pattern 180 to the area of the striking plate 120 may be from about 0 percent to about 100 percent. In one embodiment, the elliptical reinforcement pattern 180 has an area of about 0.1 $cm^2$ to about 125 $cm^2$. In another embodiment, the elliptical reinforcement pattern 180 has an area of about 5 $cm^2$ to about 100 $cm^2$. In yet another embodiment, the surface area ratio of the reinforcement pattern 180 to the area of the striking plate 120 may be from about 5 percent to about 90 percent. In still another embodiment, the surface area ratio of the reinforcement pattern 180 to the area of the striking plate 120 may be from about 55 percent to about 75 percent.

As shown in FIG. 2A, a center region 124 of the inward facing surface 122 of the striking plate 120 that is in surface-to-surface contact with the center region 154 of the reinforcing plate 150 has a concave shape and a lesser thickness, while a peripheral region 125 of the striking plate 120 that is not in surface-to-surface contact with the reinforcing plate 150 has a greater thickness (as measured in the striking-wall-to-rear-end direction). The center region 124 may have a maximum thickness from about 0.5 mm to about 2.5 mm, and the peripheral region 125 may have a maximum thickness from about 1 mm to about 3.5 mm. In one embodiment, the center region 124 may have a maximum thickness from about 1.0 mm to about 2.0 mm, and the peripheral region 125 may have a maximum thickness from about 1.5 mm to about 3.0 mm. In another embodiment, the center region 124 may have a maximum thickness from about 0.0.75 mm to about 2.25 mm, and the peripheral region 125 may have a maximum thickness from about 1.25 mm to about 3.25 mm. In other examples, however, the striking plate 120 may have a common thickness throughout. Although the striking plate 120 is not shown in FIG. 2B, the relative location of the center and peripheral regions 124 and 125 are shown by dashed reference lines. Likewise, the reinforcement pattern 180 is shown as corresponding to the overlapping areas of the center regions 124 and 154.

In some examples, the center and peripheral regions 124 and 125 of the striking wall 120 may have varying thicknesses. In one aspect, the thickness of the center region 124 may vary with the thickness increasing in directions travelling away from the center 126 of the striking plate 120. In another aspect, the thickness of the peripheral region 125 may vary with the thickness increasing in directions travelling away from the center 126 of the striking plate 120. Although the striking plate 120 is not present in FIG. 2B the relative location of the center 126 is shown by a dashed reference line.

As shown in FIG. 2A, a transition region 127 of the striking plate 120, extending between the center region 124 and the peripheral region 125, preferably has a sloping surface (e.g., a straight constant slope, or a curved slope). However, in some examples, the transition region 127 may instead have a stepped surface (e.g., sharp 90° corners, or beveled corners). Although the striking plate 120 is not present in FIG. 2B the relative location of the transition region 127 is shown by dashed reference lines.

As shown in FIG. 2A, the center region 154 of the outward facing surface 152 of the reinforcing plate 150 that is in surface-to-surface contact with the center region 124 of the striking plate 120 has a convex shape that extends further forward of the peripheral region 155 of the reinforcing plate 150 that is not in surface-to-surface contact with the striking plate 120. The reinforcing plate 150 may have a common thickness throughout from about 1 mm to about 3.5 mm. In one embodiment, the reinforcing plate 150 may have a common thickness throughout from about 1.5 mm to about 3.0 mm. In other examples, however, the center region 154 and the peripheral region 155 may have different thicknesses from one another, with the center region 154 having a thickness from about 0.5 mm to about 2.5 mm, and the peripheral region 155 having a thickness from about 1 mm to about 3.5 mm. In one embodiment, the center region 154 has a thickness from about 0.8 mm to about 2.0 mm, and the peripheral region 155 having a thickness from about 1.3 mm to about 3.0 mm. In some examples, the center region 154 and the peripheral region 155 may have varying thicknesses that increase in directions travelling toward a center 156 of the reinforcing plate 150.

As shown in FIG. 2A, a transition region 157 of the reinforcing plate 150, extending between the center region 154 and the peripheral region 155, preferably has a sloping surface (e.g., a straight constant slope, or a curved slope). However, in some examples, the transition region 157 may have a stepped surface (e.g., sharp 90° corners, or beveled corners).

With the center regions 124 and 154 in surface-to-surface contact with one another, and the peripheral regions 125 and 155 not in surface-to-surface contact with one another, there is formed in the dual-plate unit 110 both a reinforcement pattern 180 and a separation volume 190. Depending on the configuration of the transition regions 127 and 157, and the peripheral regions 125 and 155 the separation volume 190 may have either a constant thickness, or a varying thickness that increases in directions travelling away from the center 126/156 of the dual-plate unit 110. The separation volume 190 may be an empty volume occupied only by air, or may instead contain a filler material.

With the foregoing configuration, the club head 10 will impart higher ball speeds and greater driving distances to golf balls struck at the center region of the striking plate 120 corresponding with the elliptical reinforcement pattern 180. Conversely, golf balls struck at the peripheral region of the striking plate 120 not corresponding with the elliptical reinforcement pattern 180 will have relatively lesser speed and lesser driving distance.

Figure 3A:
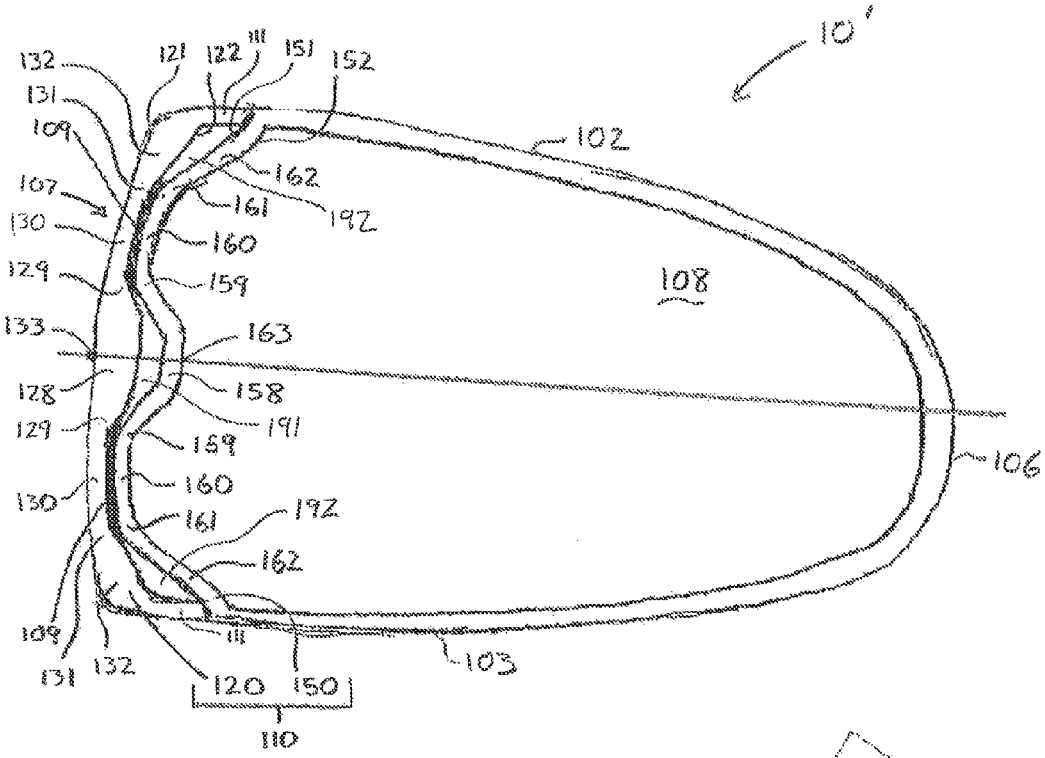
FIG. 3A illustrates a cross-sectional view of the club head, as seen along line A-A in FIG. 1
Figure 3B:
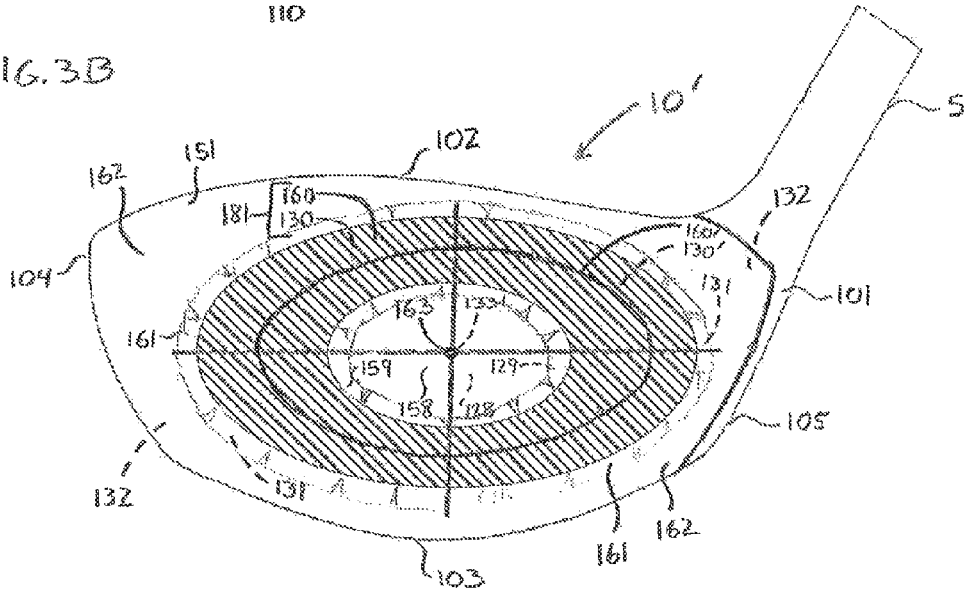
FIG. 3B illustrates a front view of the club head, as seen along line B-B in FIG. 1, with the face removed.

As shown in FIGS. 1 and 3A-3B, the club head 10' may be a metalwood-type club head for use with a metalwood-type golf club 1. The club head 10' includes a dual-plate unit 110 having a striking plate 120 and a reinforcing plate 150 that are in non-continuous surface-to-surface contact, such that the dual-plate unit 110 is provided with an elliptical-ring reinforcement pattern 181 at an intermediate region 130/160 that extends about a center region 128/158. The elliptical-ring reinforcement pattern 181 may have an area from about 0 $cm^2$ to about 150 $cm^2$; and a surface area ratio of the elliptical-ring reinforcement pattern 181 to the striking plate 120 may be from about 0 percent to about 100 percent. In one embodiment, the elliptical-ring reinforcement pattern 181 has an area from about 10 $cm^2$ to about 125 $cm^2$; and a surface area ratio of the elliptical-ring reinforcement pattern 181 to the striking plate 120 is from about 10 percent to about 90 percent. In another embodiment, the elliptical-ring reinforcement pattern 181 has an area from about 20 $cm^2$ to about 100 $cm^2$; and a surface area ratio of the elliptical-ring reinforcement pattern 181 to the striking plate 120 is from about 20 percent to about 80 percent.

As shown in FIGS. 3A-3B, an intermediate region 130 of the inward facing surface 122 of the striking plate 120 that is in surface-to-surface contact with an intermediate region 160 of the reinforcing plate 150 is formed with an elliptical-ring shape that extends about a center region 128. The intermediate region 130 is formed as a concave depression within the striking plate 120, such that the intermediate region 130 has a lesser thickness, while the center and peripheral regions 128 and 132 of the striking plate 120 have greater thicknesses. Again, thickness is measured in the striking-wall-to-rear-end direction. The intermediate region 130 may have a maximum thickness from about 0.5 mm to about 2.5 mm, the center region 128 may have a maximum thickness from about 1 mm to about 3.5 mm, and the peripheral region 132 may have a maximum thickness from about 1 mm to about 3.5 mm. In other examples, however, the striking plate 120 may have a common thickness throughout. Although the striking plate 120 is not shown in FIG. 3B, the relative location of the center, intermediate, and peripheral regions 128, 130, and 132 are shown by dashed reference lines. Likewise, the reinforcement pattern 181 is shown as corresponding to the overlapping areas of the intermediate regions 130 and 160.

In some examples, the center, intermediate, and peripheral regions 128, 130, and 132 of the striking wall 120 may have varying thicknesses. In one aspect, the thickness of the center region 128 may vary with the thickness increasing in directions travelling toward the center 133 of the striking plate 120. In another aspect, the thickness of the peripheral region 132 may vary with the thickness increasing in directions travelling away from the center 133 of the striking plate 120. In a further aspect, the thickness of the intermediate region 130 may vary with the thickness increasing in directions travelling toward a midline 130' of the intermediate region 130 away from the center 133 of the striking plate 120. Although the striking plate 120 is not shown in FIG. 3B, the relative location of the center 133 and the midline 130' of the striking plate 120 is shown by a dashed reference lines.

As shown in FIG. 3A, the striking wall 120 may have an inner transition region 129 and an outer transition region 131. The inner transition region 129 extends between the center region 128 and the intermediate region 130 and the outer transition region 131 extends between the intermediate region 130 and the peripheral region 132. Preferably, the transition regions 129 and 131 have sloping surfaces (e.g., a straight constant slope, or a curved slope). However, in some examples, one or both of the transition regions 129 and 131 may instead have stepped surfaces (e.g., sharp 90° corners, or beveled corners). Although the striking plate 120 is not shown in FIG. 3B, the relative location of the transition regions 129 and 131 are shown by dashed reference lines.

As shown in FIG. 3A, an intermediate region 160 of the outward facing surface 151 of the reinforcing plate 150 that is in surface-to-surface contact with the intermediate region 160 of the striking plate 120 is formed with a corresponding elliptical-ring shape that extends about a center region 158. The intermediate region 160 is formed as a convex shape that extends further forward of the center and peripheral regions 158 and 162, which regions 158 and 162 are not in surface-to-surface contact with the striking plate 120. The reinforcing plate 150 may have a common thickness throughout. In one embodiment, the thickness of the reinforcing plate 150 is about 2 mm or less. In other examples, however, the center, intermediate, and peripheral regions 158, 160, and 162 may have different thicknesses from one another, with the center region 158 having a thickness from about 1 mm to about 3.5 mm the intermediate region 160 having a thickness from about 0.5 mm to about 2.5 mm, and the peripheral region 162 having a thickness from about 1 mm to about 3.5 mm. In some examples, the center, intermediate, and peripheral regions 158, 160, and 162 may have varying thicknesses. In one aspect, the center region 158 may have a thickness that increases in directions travelling away from a center 163 of the reinforcing plate 150. In another aspect, the intermediate region 160 may have a thickness that increases in directions travelling toward a midline 160' of the intermediate region 160. In a further aspect, the peripheral region 162 may have a thickness that increases in directions travelling toward the center 163.

As shown in FIG. 3A, the reinforcing plate 150 has an inner transition region 159 and an outer transition region 161. The inner transition region 159 extends between the center region 158 and the intermediate region 160; and the outer transition region 161 extends between the intermediate region 160 and the peripheral region 162. Preferably, the transition regions 159 and 161 have sloping surfaces (e.g., a straight constant slope, or a curved slope). However, in some examples, the transition regions 159 and 161 may instead have stepped surfaces (e.g., sharp 90° corners, or beveled corners).

With the intermediate regions 130 and 160 in surface-to-surface contact with one another; and the center regions 128 and 138, and peripheral regions 132 and 162 not in surface-to-surface contact with one another, there is formed in the dual-plate unit 110 a reinforcement pattern 181, a center separation volume 191, and a peripheral separation volume 192. The center separation volume 191 is defined between the center regions 128 and 158; and the peripheral separation volume 192 is defined between the peripheral regions 132 and 162. Depending on the configuration of: the center regions 128 and 158; the transition regions 129, 131, 159, and 161; and the peripheral regions 132 and 162, the separation volumes 191 and 192 may have either constant thicknesses; or varying thicknesses that increase in directions travelling away from the center 133/163 of the dual-plate unit 110. In some examples, the center separation volume 191 may have a constant thickness while the peripheral separation volume 192 has a varying thickness, and vice-versa. The separation volumes 191 and 192 may be empty volumes occupied only by air, or may instead contain a filler material. In one aspect, the center separation volume 191 may be an empty volume containing only air while the peripheral separation volume 192 contains a filler material, and vice-versa.

With the foregoing configuration, the club head 10' will impart higher ball speeds, and greater driving distances to golf balls struck at the elliptical-ring region of the striking plate 120 corresponding with the elliptical-ring reinforcement pattern 181. Golf balls struck at the center and peripheral regions of the striking plate 120 not corresponding with the elliptical-ring reinforcement pattern 181 will have lesser speeds and lesser driving distance.

Figure 4:
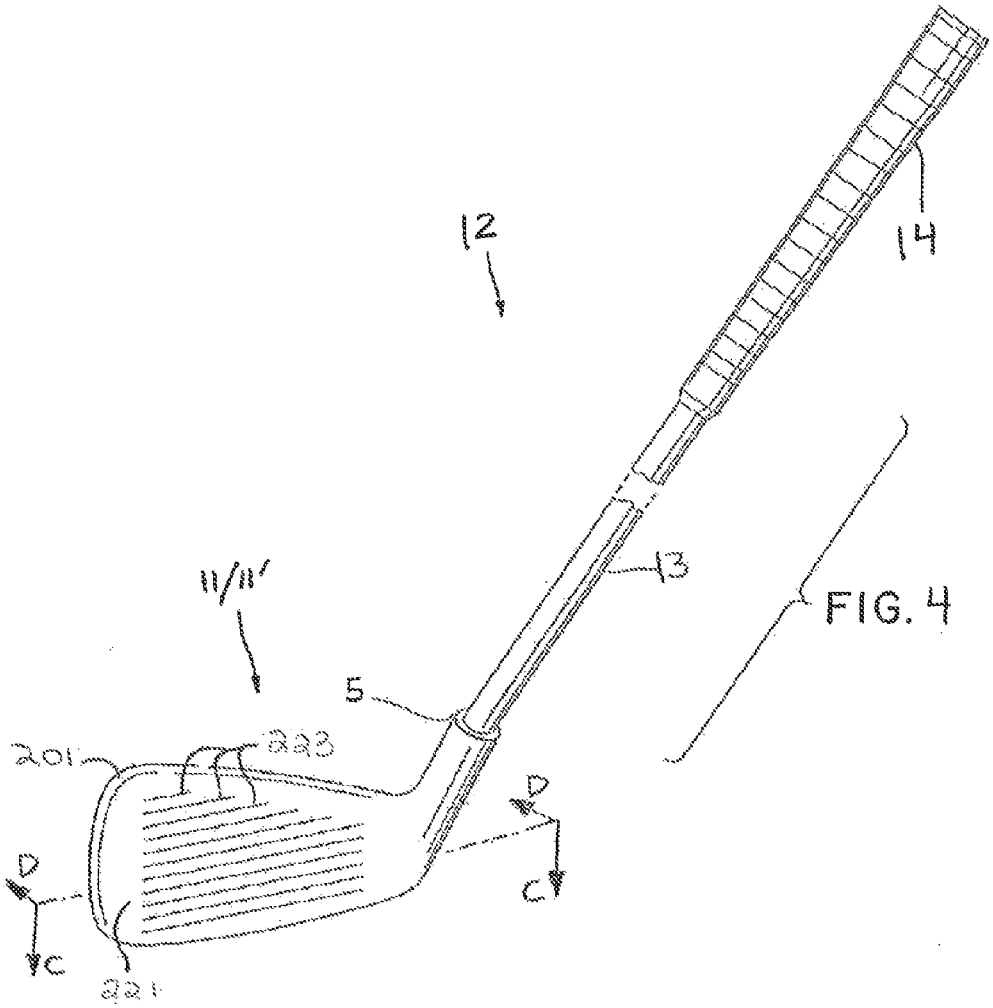
FIG. 4 illustrates an iron-type golf club according to an embodiment of the present invention.
Figure 5B:
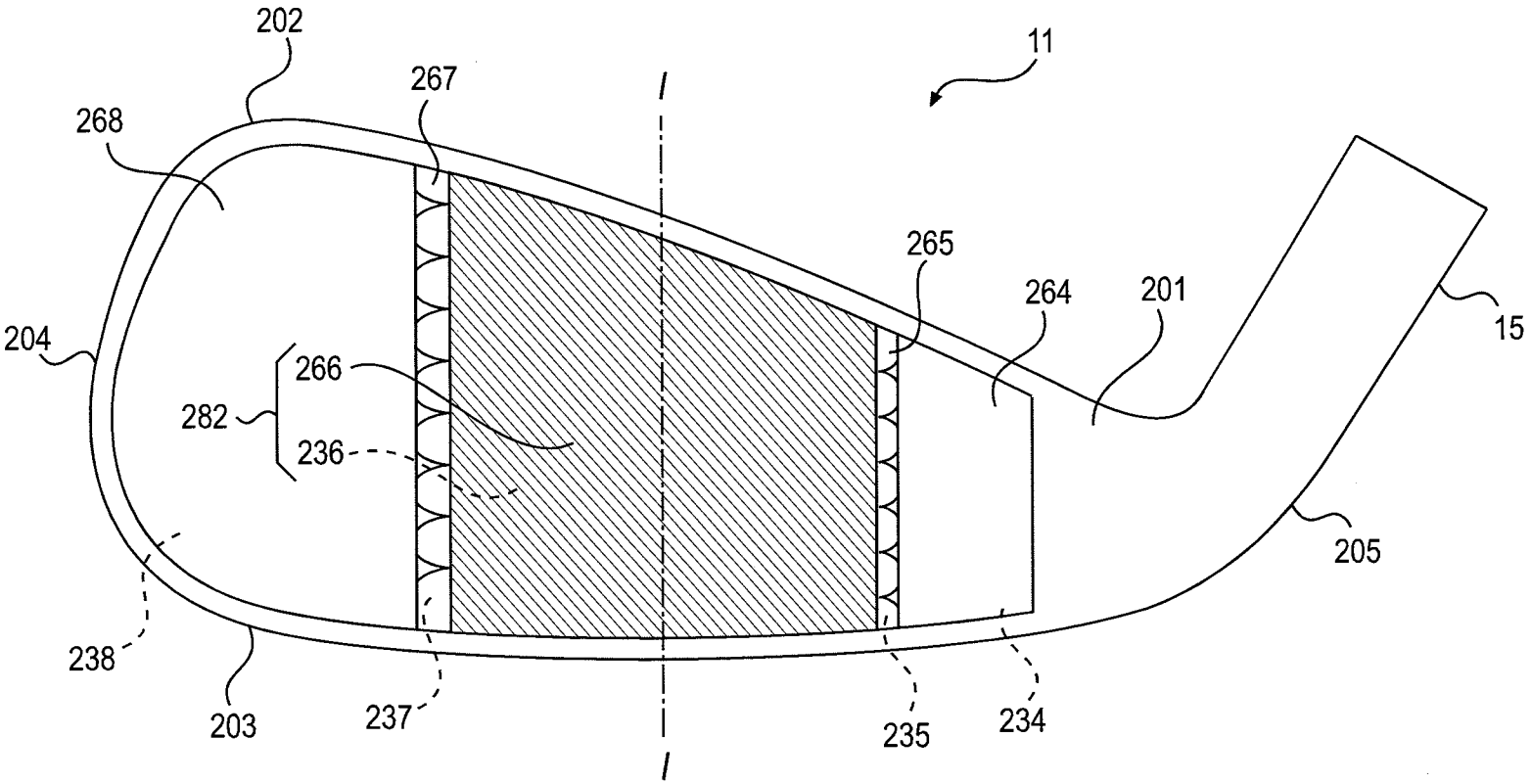
FIG. 5B illustrates a front view of the club head, as seen along line D-D in FIG. 4, with the face removed.

In another embodiment, as shown in FIGS. 4 and 5A-5B, the club head 11 may be an iron-type club head for use with an iron-type golf club 2. The club head 211 includes a dual-plate unit 210 having a striking plate 220 and a reinforcing plate 250 that are in non-continuous surface-to-surface contact, such that the dual-plate unit 210 is provided with a vertically extending reinforcement pattern 282 at a mid-region 236/266. The vertical mid-region reinforcement pattern 282 may have an area from about 0 $cm^2$ to about 100 $cm^2$. A surface area ratio of the reinforcement pattern 282 to the area of the striking plate 220 may be from about 0 percent to about 100 percent) In one embodiment, the vertical mid-region reinforcement pattern 282 has an area from about 10 $cm^2$ to about 125 $cm^2$; and a surface area ratio of the reinforcement pattern 282 to the area of the striking plate 220 of about 10 percent to about 90 percent. In another embodiment, the vertical mid-region reinforcement pattern 282 has an area from about 20 $cm^2$ to about 100 $cm^2$; and a surface area ratio of the reinforcement pattern 282 to the area of the striking plate 220 is from about 20 percent to about 80 percent.

As shown in FIG. 5A, a mid-region 236 of the inward facing surface 222 of the striking plate 220 that is in surface-to-surface contact with the mid-region 266 of the reinforcing plate 250 has a concave shape and a lesser thickness while the heel and toe peripheral regions 234 and 238 of the striking plate 220 that are not in surface-to-surface contact with the reinforcing plate 250 have greater thicknesses (as measured in the striking-wall-to-rear-end direction). The center region 236 may have a thickness from about 0.5 mm to about 2 mm, the heel peripheral region 234 may have a thickness from about 1 mm to about 3.5 mm, and the toe peripheral region 238 may have a thickness from about 1 mm to about 3.5 mm. In other examples, however, the striking plate 120 may have a common thickness throughout. Although the striking plate 220 is not shown in FIG. 5B, the relative location of the center and peripheral regions 236, 234, and 238 are shown by dashed reference lines. Likewise, the reinforcement pattern 282 is shown as corresponding to the overlapping areas of the mid-regions 236 and 266.

In some examples, the mid-region and peripheral regions 236, 234, and 238 of the striking wall 220 may have varying thicknesses. In one aspect, the thickness of the mid-region 236 may vary with the thickness increasing in directions travelling away from a center line I-I that vertically bisects the mid-region 236. In another aspect, the thicknesses of the heel and toe peripheral regions 234 and 238 may vary with the thicknesses increasing in respective directions travelling away from the line I-I. Although the striking plate 220 is not shown in FIG. 5B, the relative location of the bisecting line I-I is shown.

As shown in FIG. 5A, the striking plate 220 includes a heel transition region 235 and a toe transition region 237. The heel transition region 235 extends between the heel peripheral region 234 and the mid-region 236; and the toe transition region 237 extends between the mid-region 236 and the toe peripheral region 238. Preferably, the transition regions 235 and 237 have sloping surfaces (e.g., a straight constant slope, or a curved slope). However, in some examples, one or both of the transition regions 235 and 237 may instead have stepped surfaces (e.g., sharp 90° corners, or beveled corners). Although the striking plate 220 is not present in the view of FIG. 5B the relative location of the transition regions 235 and 237 are shown by dashed reference lines.

As shown in FIG. 5A, the mid-region 266 of the outward facing surface 252 of the reinforcing plate 250 that is in surface-to-surface contact with the center region 236 of the striking plate 220 has a convex shape that extends further forward of the heel and toe peripheral regions 264 and 268 of the reinforcing plate 250, which peripheral regions 264 and 268 are not in surface-to-surface contact with the striking plate 220. The reinforcing plate 250 may have a common thickness throughout from about 0.5 mm to about 3.5 mm and ranges there between. In other examples, however, the mid-region 266 and the peripheral regions 264 and 268 may have different thicknesses from one another, with the mid-region 266 having a thickness from about 0.5 mm to about 2 mm, the heel peripheral region 264 having a thickness from about 1 mm to about 3.5 mm, and the toe peripheral region 268 having a thickness from about 1 mm to about 3.5 mm. In some examples, the mid-region 266 and the peripheral regions 264 and 268 may have varying thicknesses that increase in directions travelling away from a center line I-I that vertically bisects the mid-region 266.

As shown in FIG. 5A, the reinforcing plate 250 includes a heel transition region 265 and a toe transition region 267. The heel transition region 265 extends between the heel peripheral region 264 and the mid-region 266; and the toe transition region 267 extends between the mid-region 266 and the toe peripheral region 268. Preferably, the transition regions 265 and 267 have sloping surfaces (e.g., a straight constant slope, or a curved slope). However, in some examples, one or both of the transition regions 265 and 267 may instead have stepped surfaces (e.g., sharp 90° corners, or beveled corners).

With the mid-regions 236 and 266 in surface-to-surface contact with one another, while the heel peripheral regions 234 and 264 and the toe peripheral regions 238 and 268 are not in surface-to-surface contact with one another, there is formed in the dual-plate unit 210 a reinforcement pattern 282, a heel separation volume 293, and a toe separation volume 294. The heel separation volume 293 is defined between the heel peripheral regions 234 and 264; and the toe peripheral separation volume 294 is defined between the toe peripheral regions 238 and 268. Depending on the configuration of the transition regions 235, 237, 265, and 267, and the peripheral regions 234, 238, 264, and 268 the separation volumes 293 and 294 may have either constant thicknesses; or varying thicknesses that increase in directions travelling away from a line I-I that vertically bisects the dual-plate unit 220. In some examples, the heel separation volume 293 may have a constant thickness while the toe separation volume 294 has a varying thickness, and vice-versa. The separation volumes 293 and 294 may be empty volumes occupied only by air, or may instead contain a filler material. In one aspect, the heel separation volume 293 may be an empty volume containing only air while the toe separation volume 294 contains a filler material, and vice-versa.

With the foregoing configuration, the club head 11 will impart higher ball speeds, and greater driving distances to golf balls struck at the mid-region of the striking plate 220 corresponding with the vertically extending mid-region reinforcement pattern 282 and will impart relatively lesser ball speeds, and lesser driving distances to golf balls struck at the peripheral regions of the striking plate 220 not corresponding with the reinforcement pattern 282.

Figure 6A:
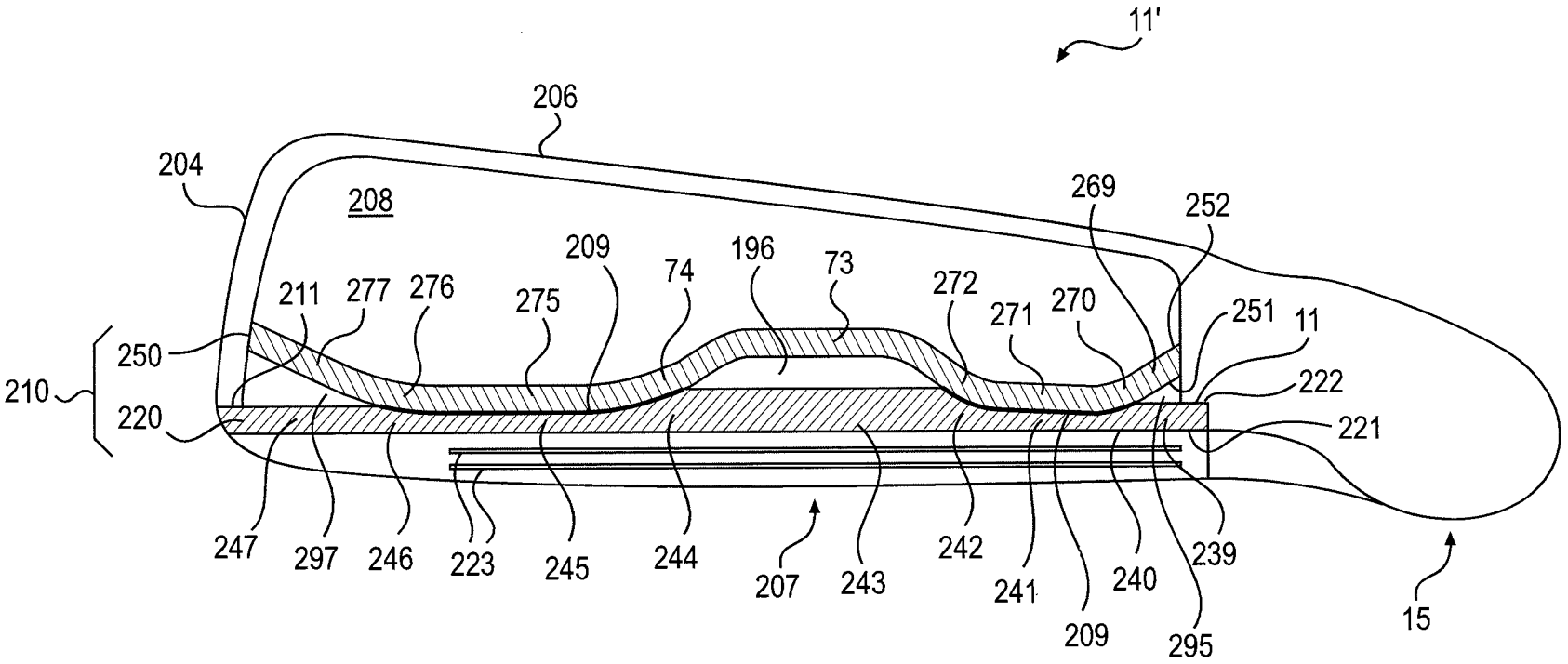
FIG. 6A illustrates a cross-sectional view of the club head, as seen along line C-C in FIG. 4
Figure 6B:
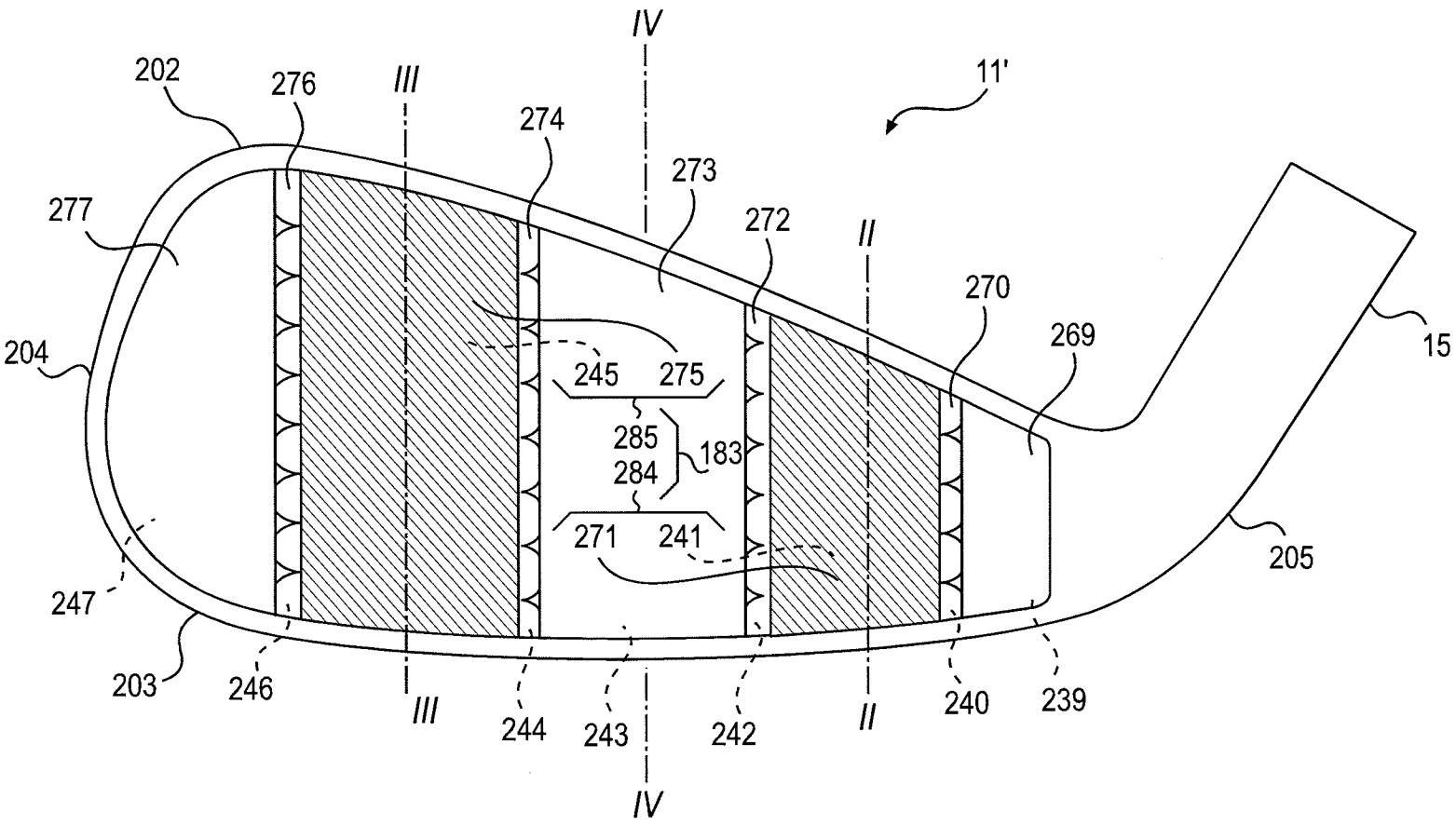
FIG. 6B illustrates a front view of the club head, as seen along line D-D in FIG. 4, with the face removed.

In yet another embodiment, as shown in FIGS. 4 and 6A-6B, the club head 11' is an iron-type club head for use with an iron-type golf club 2. The club head 11' includes a dual-plate unit 210 having a striking plate 220 and a reinforcing plate 250 that are in non-continuous surface-to-surface contact, such that the dual-plate unit 210 is provided with a combined heel-toe reinforcement pattern 283. The heel-toe reinforcement pattern 283 includes both a heel reinforcement zone 284 at a heel intermediate region 241/271 of the dual-plate unit 210, and a toe reinforcement zone 285 at a toe intermediate region 245/275 of the dual-plate unit 210. The heel reinforcement zone 284 may have an area of about 40 $cm^2$ or less and the toe reinforcement zone 285 may have an area of about 60 $cm^2$ or less. In this aspect, the combined heel-toe reinforcement pattern 283 may have an area of about 100 $cm^2$. A surface area ratio of the heel reinforcement zone 284 to the area of the striking plate 220 may be about 40 percent or less, and a surface area ratio of the toe reinforcement zone 285 to the area of the striking plate 220 may be about 60 percent or less. A surface area ratio of the heel-toe reinforcement pattern 283 to the area of the striking plate 220 may be about 100 percent or less. In one embodiment, the surface area ratio of the heel-toe reinforcement pattern 283 to the area of the striking plate 220 is about 90 percent or less. In another embodiment, the surface area ratio of the heel-toe reinforcement pattern 283 to the area of the striking plate 220 is about 75 percent or less.

As shown in FIG. 6A, both a heel intermediate region 2242 and a toe intermediate region 2245 of the inward facing surface 222 of the striking plate 220 are in surface-to-surface contact with corresponding heel and toe intermediate regions 271 and 275 of the reinforcing plate 250. The heel and toe intermediate regions 241 and 245 of the striking plate 220 are formed with a concave shape and a lesser thickness; while the mid-region 243 and heel and toe peripheral regions 239 and 247 of the striking plate 220, that are not in surface-to-surface contact with the reinforcing plate 150, have greater thicknesses (as measured in the striking-face-to-rear-end direction). The heel intermediate region 241 may have a maximum thickness from about 0.5 mm to about 2 mm, the toe intermediate region 245 may have a maximum thickness from about 0.5 mm to about 2 mm, the mid-region 243 may have a maximum thickness from about 1 mm to about 3.5 mm, the heel peripheral region 239 may have a maximum thickness from about 1 mm to about 3.5 mm, and the toe intermediate region 247 may have a maximum thickness from about 1 mm to about 3.5 mm (and ranges there between). In other examples, however, the striking plate 120 may have a common thickness throughout.

Although the striking plate 220 is not shown in FIG. 6B, the relative locations of the center region 243, the heel and toe intermediate regions 241 and 245, and the heel and toe peripheral regions 239 and 247 are shown by dashed reference lines. Likewise, the heel reinforcement zone 284 is shown as corresponding to the overlapping areas of the heel inter mediate regions 241 and 271; the toe reinforcement zone 285 is shown as corresponding to the overlapping areas of the toe inter mediate regions 245 and 275; and the reinforcement pattern 283 is shown as corresponding to the combined heel and toe reinforcement zones 284 and 285.

In some examples, one or more of the mid-region 243, the toe and heel intermediate regions 241 and 245, and the toe and heel peripheral regions 239 and 247 of the striking plate 220 may have varying thicknesses. In one aspect, the thickness of the heel intermediate region 242 may increase in directions travelling away from a line II-II that vertically bisects the heel intermediate region 241. In another aspect, the thickness of the toe intermediate region 245 may increase in directions travelling away from a line III-III that vertically bisects the toe intermediate region 245. In a further aspect, the thickness of the heel peripheral region 239 may increase in a direction travelling away from the bisecting line II-II. In yet another aspect, the thickness of the toe peripheral region 247 may increase in a direction travelling away from the bisecting line III-III. In yet a further aspect, the thickness of the mid-region 243 may increase in directions travelling toward a line IV-IV that vertically bisects the mid-region 243. Although the striking plate 220 is not shown in FIG. 6B, the relative location of the bisecting lines II-II, III-III, and IV-IV are shown.

As shown in FIG. 6A, the striking plate 220 includes a pair of heel transition regions 240 and 242 positioned about the heel intermediate region 241, and a pair of toe transition regions 244 and 246 positioned about the toe intermediate region 245. The pair of heel transition regions 240 and 242 includes an outer heel transition region 240 that extends between the heel intermediate region 241 and a heel peripheral region 239; and an inner heel transition region 242 that extends between the heel intermediate region 241 and the mid-region 243. The pair of toe transition regions 244 and 246 includes an outer toe transition region 246 that extends between the toe intermediate region 245 and a toe peripheral region 247; and an inner toe transition region 244 that extends between the toe intermediate region 245 and the mid-region 243. Preferably, the transition regions 240, 242, 244, and 246 have sloping surfaces (e.g., a straight constant slope, or a curved slope). However, in some examples, one or more of the transition regions 240, 242, 244, and 246 may instead have stepped surfaces (e.g., sharp 90° corners, or beveled corners). Although the striking plate 220 is not present in FIG. 6B the relative locations of the transition regions 240, 242, 244, and 246 are shown by dashed reference lines.

As shown in FIG. 6A, the outward facing surface 252 of the reinforcing plate 250 includes a heel intermediate region 271 and a toe intermediate region 275 that are in surface-to-surface contact with the heel intermediate region 241 and a toe intermediate region 245 of the striking plate 220, respectively. The heel and toe intermediate regions 271 and 275 are formed as convex shapes on the outward facing surface 252 that extend further forward of the mid-region 273 and the heel and toe peripheral regions 269 and 277 of the reinforcing plate 250; which regions 273, 269, and 277 are not in surface-to-surface contact with the striking plate 220. The reinforcing plate 250 may have a common thickness throughout from about 0.5 mm to about 3.5 mm (and ranges there between). In other examples, however, the regions 269, 271, 273, 275, and 277 may have different thicknesses from one another. The heel intermediate region 271 may have a maximum thickness from about 0.5 mm to about 2 mm, the toe intermediate region 275 may have a maximum thickness from about 0.5 mm to about 2 mm, the mid-region 273 may have a maximum thickness from about 0.1 mm to about 3.5 mm, the heel peripheral region 269 may have a maximum thickness from about 0.1 mm to about 3.5 mm, and the toe intermediate region 277 may have a maximum thickness from about 0.1 mm to about 3.5 mm (and ranges there between).

In some examples, one or more of the mid-region 273, the toe and heel intermediate regions 271 and 275, and the toe and heel peripheral regions 269 and 277 of the reinforcing plate 250 may have varying thicknesses. In one aspect, the thickness of the heel intermediate region 271 may increase in directions travelling toward a line II-II that vertically bisects the heel intermediate region 271. In another aspect, the thickness of the toe intermediate region 275 may increase in directions travelling toward a line III-III that vertically bisects the toe intermediate region 275. In a further aspect, the thickness of the heel peripheral region 269 may increase in a direction travelling away from the bisecting line II-II. In yet another aspect, the thickness of the toe peripheral region 277 may increase in a direction travelling away from the bisecting line III-III. In yet a further aspect, the thickness of the mid-region 273 may increase in directions travelling away from a line IV-IV that vertically bisects the mid-region 273.

As shown in FIG. 6A, the reinforcing plate 250 includes a pair of heel transition regions 270 and 272 positioned about the heel intermediate region 271, and a pair of toe transition regions 274 and 276 positioned about the toe intermediate region 275. The pair of heel transition regions 270 and 272 includes an outer heel transition region 270 that extends between the heel intermediate region 271 and a heel peripheral region 279; and an inner heel transition region 272 that extends between the heel intermediate region 271 and the mid-region 273. The pair of toe transition regions 274 and 276 includes an outer toe transition region 276 that extends between the toe intermediate region 275 and a toe peripheral region 277; and an inner toe transition region 274 that extends between the toe intermediate region 275 and the mid-region 273. Preferably, the transition regions 270, 272, 274, and 276 have sloping surfaces (e.g., a straight constant slope, or a curved slope). However, in some examples, one or more of the transition regions 270, 272, 274, and 276 may instead have stepped surfaces (e.g., sharp 90° corners, or beveled corners).

With the heel intermediate regions 241 and 271 in surface-to-surface contact with one another there is created a heel reinforcement zone 284. Likewise, with the toe intermediate regions 245 and 275 in surface-to-surface contact with one another there is created a toe reinforcement zone 285. Together heel reinforcement zone 284 and the toe reinforcement zone 285 together define a combined heel-toe reinforcement pattern 283 in the dual-plate unit 210. In addition, with the mid-regions 243 and 273, the heel intermediate regions 239 and 269, and the toe intermediate regions 247 and 277 not in surface-to-surface contact with one another there is formed in the dual-plate unit 210 a plurality of separation volumes 295-297. The plurality of separation volumes 295-297 includes a mid-region separation volume 296 between the mid-regions 243 and 273, a heel separation volume 295 between the heel peripheral regions 239 and 269, and a toe separation volume 297 between the toe peripheral regions 247 and 277. Depending on the configuration of the transition regions 240, 242, 244, 246, 270, 272, 274, and 276, the peripheral regions 239, 247, 269, 277, and the mid-regions 243 and 273, the separation volumes 295-297 may have either constant thicknesses or varying thicknesses. In some examples, the mid-region separation volume 296 may have a constant thickness, while the heel separation volume 295 has a thickness increases in a direction travelling away from the bisecting line II-II and the toe separation volume 297 has a thickness that increases in a direction travelling away from the bisecting line III-III. In another example, the heel and toe separation volumes 295 and 297 may have constant thicknesses, while the mid-region separation volume 296 has a thickness that increases in directions travelling away from the bisecting line IV-IV. Further examples may have various combinations of the foregoing constant and varying thicknesses for the separation volumes 295-297. The separation volumes 295-297 may be empty volumes occupied only by air, or may instead contain a filler material. In one aspect, the mid-region separation volume 296 may be an empty volume containing only air, while the heel and toe separation volumes 295 and 297 contain filler materials, and vice-versa.

With the foregoing configuration, the club head 11' will impart higher ball speeds, and greater driving distances as compared to prior art club heads. In particular, it is understood that golf balls struck at the mid-region of a club head will have higher ball speed and distance as compared to golf balls struck at the heel or toe due to the lack of reinforcement in the heel and toe areas. However, the club head of the present invention provides an increased sweet spot because the ball speed and distance in the heel and toe area are increased.

Methods of Making the Golf Club Head

A golf club head 10/11 of the present invention may be constructed with a club head body 101/201 that is composed of one or more of the following materials: titanium, steel, titanium or steel alloys, composite materials, polymer materials, and combinations thereof.

The striking plate 120/220 may be constructed from the same or different materials as the club body 101/201. Non-limiting examples of materials that may be used to construct the striking plate 120/220 may include one or more of titanium, steel, titanium or steel alloys, composite materials, polymer materials, and combinations thereof.

The reinforcing plate 150/250 may be constructed from the same or different materials as the club body 101/201, and also from the same or different materials as the striking plate 120/220. Non-limiting examples of materials that may be used to construct the reinforcing plate 150/250 may include one or more of titanium, steel, titanium or steel alloys, composite materials, polymer materials, and combinations thereof.

In one aspect, as shown in FIGS. 2A and 3A, the club body 101 may be a monolithic member including the crown 102, the sole 103, the toe end 104, the heel end 105, the rear end 106, and the reinforcing plate 150. The striking plate 120 may be a separate component that is secured to the club head body 101. In such an embodiment, the lubrication 109 is applied to one or both of the outward facing surface 151 of the reinforcing plate 150 and the inward facing surface 122 of the striking plate 120 before joining the striking plate 120 to the club head 101.

In such an embodiment, the striking plate 120 preferably has a cup-shaped construction such that an outer rim 111 of the striking plate 120 projects rearward of the striking plate 120 to accommodate for an irregular surface presented by projections on the outward facing surface 151 of the reinforcing plate 150. In this manner, the outer rim 111 extends rearward and lies flush with the outer boundary of the club body 101 (e.g., the outer surfaces 102-105), to form a seamless extension of the club body 101. Alternatively, the outer rim 111 may be a forward extension of the club body 101, and the striking plate 120 may be a plate-shaped construction such that the striking plate 120 lies flush with the outer rim 111. In yet another alternative, the outer rim 111 may be a forward extension of the club body 101 and extends around a forward corner of the club head 101 to present a stepped reception channel on the striking wall 107, and the striking plate 120 may be a plate-shaped construction that is inserted into the stepped channel formed by the outer rim 111 on the face surface of the striking wall 107.

The striking plate 120 may be secured to the club body 101 in either a releasable or non-releasable fashion. Non-limiting examples for securing the striking plate 120 in a non-releasable fashion may include use of one or more of the following: adhesives, cements, welding, brazing, soldering, and fusing methods. Non-limiting examples for securing the striking plate 120 in a releasable fashion, may include use of one or more of the following: mating male-female connections (e.g., tongues and grooves), mating snap-fit connections (e.g., flexing ridges and channels), corresponding through-holes and blind-holes carrying one or more threads for receiving a threaded fastener (e.g., threaded holes for reception of a screw), and releasable retaining elements. If secured in a resalable fashion, the striking plate 120 may be freely removable to permit a user to replace the striking plate 120 and/or the lubrication 109. Depending on the chosen securing structure, the striking plate 120 may be removable only through use of a tool (e.g., for a threaded screw), or may be removable without the use of a tool (e.g., a snap-fit engagement).

In a second aspect, as shown in FIGS. 5A and 6A, the club body 201 may be a monolithic member including the crown 202, the sole 203, the toe end 204, the heel end 205, and the rear end 206, with an open end at the striking wall side 207 exposing the hollow space 208. The reinforcing plate 250 may be a separate component that is inserted and secured within the hollow space 208; and the striking plate 120 may be a separate component that is secured to the club head body 201. In such an embodiment, the lubrication 209 is applied to one or both of the outward facing surface 251 of the reinforcing plate 250 and the inward facing surface 222 of the striking plate 220 before joining the striking plate 220 to the club head 201 (either before or after inserting the reinforcement plate 250). In such an embodiment, the striking plate 220 preferably has a plate-shaped construction such that an outer rim 211 of the striking plate 220 lies flush with the outer boundary of the club head body 201 (e.g., the outer surfaces 202-205), to form a seamless extension of the club head body 201.

One or both of the striking plate 120/220 and the reinforcing plate 150/250 may be secured to the club head body 101/201 in either a releasable or a non-releasable fashion. If secured in a resalable fashion, the striking plate 120/220 may be freely removable to permit a user to replace the striking plate 120/220 and/or the lubrication 109/209. If the reinforcing plate 150/250 is also secured in a releasable fashion, a user may replace the reinforcing plate 150/250 with another reinforcement plate having a different reinforcement pattern, and the also replace the striking plate 120/220 with another striking plate having a reinforcement pattern corresponding with the newly replaced reinforcement plate. Depending on the chosen securing structures, one or both of the striking plate 120/220 and the reinforcing plate 150/250 may be removable only through use of a tool (e.g., for a threaded screw), or may be removable without the use of a tool (e.g., a snap-fit engagement). In one example, the striking plate 120/220 may be removable only through the use of a tool, and the reinforcing plate 150/250 may be removable without the use of a tool, and vice versa.

In a third aspect, the club body 101/201 may again be a monolithic member including the crown 102/202, the sole 103/203, the toe end 104/204, the heel end 105/205, and the rear end 106/206, with an open end at the striking wall side 107/207 exposing the hollow space 108/208. In this embodiment, the dual-plate unit 110/210 is an integral member made by securing the striking plate 120/220 to the reinforcing plate 150/250 in a non-releasable fashion. The lubrication 109 is applied to one or both of the outward facing surface 151/251 of the reinforcing plate 150/250 and the inward facing surface 122/222 of the striking plate 120/220, prior to securing the two plates together. In such an embodiment, the reinforcing plate 150/250 is a rear extension of the dual-plate unit 110/210 that is inserted into the hollow space 108/208, and the striking plate 120/220 preferably has a plate-shaped construction such that an outer rim 11/211 of the striking plate 120/220 lies flush with the outer boundary of the club body 101/201 (e.g., the outer surfaces 102-105/202-205), to form a seamless extension of the club body 101/201.

The dual-plate unit 110/210 may be secured to the club body 101/201 in either a releasable or a non-releasable fashion. If secured in a resalable fashion, the dual-plate unit 110/210 may be freely removable to permit a user to replace the dual-plate unit 110/210 with another dual-plate unit having a different reinforcement pattern. In this embodiment, however, a user will not be able to separate the striking plate 120/220 and the reinforcing plate 150/250. This will prevent a user from interfering with the lubrication 109/209, and simplifies the interchanging of dual-plate units by avoiding inadvertent pairings of striking plates and reinforcing plates that have non-corresponding reinforcement patterns. Depending on the chosen securing structure, the dual-plate unit 110/210 may be removable only through use of a tool (e.g., for a threaded screw), or may be removable without the use of a tool (e.g., a snap-fit engagement).

In another aspect, the club body 101/201 may be a monolithic member including the crown 102/202, the toe end 104/204, the heel end 105/205, and the striking plate 120/220, with open surfaces at both the sole side 103/203 the rear end side 106/206 exposing the hollow space 108/208. The reinforcing plate 150/250, the sole 103/203, and the rear end 106/206 may be a separate monolithic member that engages the club head body 101/201. In such an embodiment, the lubrication 109 is applied to one or both of the outward facing surface 151/251 of the reinforcing plate 150/250 and the inward facing surface 122/222 of the striking plate 120/220 before joining the monolithic member 150-103-106/250-203-206 to the club head 101/201. In such an embodiment, both the sole 103/203 and the rear end 106/206 preferably have outer rims that lie flush with the outer boundary of the club body 101/201 (e.g., the outer surfaces 102/202, 104/204, 105/205, and 120/220), to form a seamless extension of the club body 101/201.

The monolithic member 150-103-106/250-203-206 may be secured to the club body 101/201 in either a releasable or a non-releasable fashion. In one example, the monolithic member 150-103-106/250-203-206 engages the club body 101/201 by sliding a pair of tongue and/or groove members on the sole 103/203 along a mating pair of groove and/or tongue members on the toe and heel ends 104/204 and 105/205 of the club body 101/201. In a second example, the monolithic member 150-103-106/250-203-206 engages the club body 101/201 simply be aligning the respective edges and securing them by a non-releasable structure (e.g., a weld seam) or a releasable structure (e.g., screws). If secured in a resalable fashion, the monolithic member 150-103-106/250-203-206 may be freely removable to permit a user to replace the monolithic member and/or the lubrication 109/209 between the striking plate 120/220 and the reinforcing plate 150/250.

Although the present invention has been described with reference to particular embodiments, it will be understood to those skilled in the art that the disclosure herein is exemplary only and that various other alternatives, adaptations, and modifications may be made within the scope and spirit of the present invention. Ranges provided herein also encompass ranges within the overall ranges. Indeed, if a thickness is about 1 mm to about 3.5 mm, ranges there between are contemplated to be within the scope of the invention, e.g., about 1.5 mm to about 3.0 mm, and the like.

For example, although some of the foregoing assembly methods are discussed relative to specific examples in the figures, those skilled in the art will understand that each of the foregoing assembly methods may be practiced with any given embodiment of the present invention. Also, although the foregoing examples discuss regions of varying thickness having thicknesses that increase in a particular direction, those skilled in the art will understand that those same regions may instead be constructed with varying thicknesses that decrease in the stated directions. Likewise, those skilled in the art will understand that regions having varying thicknesses may be constructed with varying thicknesses only in part (e.g., a particular region with varying thickness may have a constant thickness at its center, with the varying thickness being only at the periphery of the center). Furthermore, where the foregoing examples discuss transition regions being regions extending between other regions that are in surface-to-surface contact and other regions that are not in surface-to-surface contact, those skilled in the art will understand that the transition regions may be constructed to themselves be entirely, or partly, in surface-to-surface contact with opposing transition regions; or to be entirely not in surface-to-surface contact with opposing transition regions. Further yet, although the foregoing examples are directed to reinforcement patterns having particular shapes and dimensions, those skilled in the art will understand that the present invention may be practices with reinforcement patterns having different shapes and/or dimensions; and that one or more of the foregoing reinforcement patterns may be combined into a single reinforcement pattern. In addition, although the foregoing examples are directed to dual-plate units having a striking plate and a reinforcing plate, those skilled in the art will understand that the principles of the present invention may also be practiced with arrangements of three or more plate members; and that golf club heads in accordance with the present invention may include additional features, if desired, including features that are known and used in the art.

To the extent necessary to understand or complete the disclosure of the present invention, all publications, patents, and patent applications mentioned herein are expressly incorporated by reference herein to the same extent as though each were individually so incorporated. In addition, ranges expressed in the disclosure are considered to include the endpoints of each range, all values in between the end points, and all intermediate ranges subsumed by the end points.

Accordingly, the present invention is not limited to the specific embodiments as illustrated herein, but is instead characterized by the appended claims.

What is claimed is:

1. A golf club head comprising:

a body comprising a striking face and an inner volume, wherein the striking face comprises a striking plate, a reinforcing plate, and a separation volume disposed between the striking plate and the reinforcing plate, wherein the striking plate comprises an outer surface that faces outward from the club body and an inner surface that faces the inner volume of the body, wherein the striking plate comprises a plurality of regions, wherein the reinforcing plate comprises a first surface that faces the inner surface of the striking plate and a second surface that faces the inner volume of the body, and wherein the separation volume has a variable thickness and comprises lubricant.

2. The golf club head of claim 1, wherein lubricant has a thickness from about 0.1 micron to about 1 micron.

3. The golf club head of claim 1, wherein the plurality of regions comprises at least one recessed region on the inner surface having a lesser thickness than other of the plurality of regions.

4. The golf club head of claim 1, wherein the first surface comprises at least one protruding region with a greater thickness than one or more other regions of the reinforcing plate.

5. The golf club head of claim 1, wherein the plurality of regions comprises at least one recessed region on the inner surface having a lesser thickness than other of the plurality of regions, wherein the first surface comprises at least one protruding region with a greater thickness than one or more other regions of the reinforcing plate, and wherein the at least one protruding region mates with the at least one recessed region in the striking plate to define at least one reinforced region within the striking face.

6. The golf club head of claim 5, wherein the at least one recessed region comprises a first recessed region and a second recessed region, and wherein the at least one protruding region comprises a first protruding region and a second protruding region, and wherein the first recessed region mates with the first protruding region and the second recessed region mates with the second protruding region.

7. The golf club head of claim 6, wherein the separation volume comprises a first lubricant between the first recessed region and the first protruding region, and wherein the separation volume comprises a second lubricant between the second recessed region and the second protruding region.

8. The golf club head of claim 5, wherein the at least one reinforced region corresponds with a center of the striking face, and excludes both a heel region and a toe region of the striking face.

9. The golf club head of claim 8, wherein the at least one reinforced region comprises an elliptical shape.

10. The golf club head of claim 8, wherein the at least one reinforced region extends from approximately a sole end of the striking face to a crown end of the striking face.

11. A golf club head comprising:

a body comprising a striking face and an inner volume, wherein the striking face comprises a striking plate, a reinforcing plate, and a separation volume disposed between the striking plate and the reinforcing plate, wherein the striking plate comprises an outer surface that faces outward from the club body and an inner surface that faces the inner volume of the body, wherein the striking plate comprises a plurality of regions, wherein the reinforcing plate comprises a first surface that faces the inner surface of the striking plate and a second surface that faces the inner volume of the body, and wherein the separation volume has a variable thickness and comprises a filler material.

12. The golf club head of claim 11, wherein the plurality of regions comprises at least one recessed region on the inner surface having a lesser thickness than other of the plurality of regions.

13. The golf club head of claim 11, wherein the first surface comprises at least one protruding region with a greater thickness than one or more other regions of the reinforcing plate.

14. The golf club head of claim 11, wherein the plurality of regions comprises at least one recessed region on the inner surface having a lesser thickness than other of the plurality of regions, wherein the first surface comprises at least one protruding region with a greater thickness than one or more other regions of the reinforcing plate, and wherein the at least one protruding region mates with the at least one recessed region in the striking plate to define at least one reinforced region within the striking face.

15. The golf club head of claim 11, wherein the filler material comprises rubber, foam, or combinations thereof.

16. A golf club head comprising:

a body comprising a striking face and an inner volume, wherein the striking face comprises a striking plate and a reinforcing plate, wherein the striking plate comprises an outer surface that faces outward from the club body and an inner surface that faces the inner volume of the body, wherein the striking plate comprises a plurality of regions, wherein the plurality of regions comprises at least two recessed regions on the inner surface having a lesser thickness than other of the plurality of regions, wherein the reinforcing plate comprises a first surface that faces the inner surface of the striking plate and a second surface that faces the inner volume of the body, wherein the first surface comprises at least two protruding regions with a greater thickness than one or more other regions of the reinforcing plate, wherein the at least two protruding regions mate with the at least two recessed regions in the striking plate to define at least two reinforced regions within the striking face, and wherein the at least two reinforced regions each extend from approximately a sole end of the striking face to a crown end of the striking face.

17. The golf club head of claim 16, wherein the at least two reinforced regions comprise a heel intermediate region and a toe intermediate region.

18. The golf club head of claim 16, wherein the striking face comprises a separation volume disposed between the striking plate and the reinforcing plate.

19. The golf club head of claim 18, wherein the separation volume comprises at least one region comprising lubricant.

20. The golf club head of claim 18, wherein the separation volume comprises air, a filler material, or a combination thereof.

* * * * *